US010844449B2

(12) United States Patent
Yoshimoto et al.

(10) Patent No.: US 10,844,449 B2
(45) Date of Patent: Nov. 24, 2020

(54) RAPID-COOLING QUENCHING APPARATUS AND RAPID-COOLING QUENCHING METHOD

(71) Applicant: JFE Steel Corporation, Tokyo (JP)

(72) Inventors: Soshi Yoshimoto, Tokyo (JP); Hirokazu Sugihara, Tokyo (JP); Fujio Tanaka, Tokyo (JP); Tomohiro Hashimukai, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 233 days.

(21) Appl. No.: 16/066,481

(22) PCT Filed: Dec. 26, 2016

(86) PCT No.: PCT/JP2016/088643
§ 371 (c)(1),
(2) Date: Jun. 27, 2018

(87) PCT Pub. No.: WO2017/115742
PCT Pub. Date: Jul. 6, 2017

(65) Prior Publication Data

US 2019/0010564 A1 Jan. 10, 2019

(30) Foreign Application Priority Data

Dec. 28, 2015 (JP) ..... 2015-256541
Dec. 9, 2016 (JP) ..... 2016-238977

(51) Int. Cl.
*C21D 1/63* (2006.01)
*C21D 9/573* (2006.01)
*C21D 1/18* (2006.01)

(52) U.S. Cl.
CPC ..... *C21D 1/63* (2013.01); *C21D 9/573* (2013.01); *C21D 9/5737* (2013.01); *C21D 1/18* (2013.01)

(58) Field of Classification Search
CPC ..... C21D 1/63; C21D 9/573; C21D 9/5737
See application file for complete search history.

(56) References Cited

U.S. PATENT DOCUMENTS

2012/0068391 A1* 3/2012 Eto ..... B21B 45/0218 266/44

FOREIGN PATENT DOCUMENTS

CN 101993995 A 3/2011
CN 104451117 A 3/2015
(Continued)

OTHER PUBLICATIONS

International Search Report and Written Opinion for International Application No. PCT/JP2016/088643, dated Apr. 4, 2017—6 pages.
(Continued)

*Primary Examiner* — Scott R Kastler
(74) *Attorney, Agent, or Firm* — Ratnerprestia

(57) ABSTRACT

A rapid-cooling quenching apparatus in which a high-temperature metal sheet is dipped and cooled in a liquid and a rapid-cooling quenching method for a steel sheet are provided. The rapid-cooling quenching apparatus includes a water tank containing the liquid in which the metal sheet is dipped, a jetting device having a plurality of nozzles through which the liquid is jetted onto front and back surfaces of the metal sheet and at least some of which are placed in the liquid in the water tank, and a pair or a plurality of pairs of restraining rolls which are placed between an entrance-side end of the jetting device and an exit-side end of the jetting device and restrain the metal sheet, in which nozzles nearest
(Continued)

to the restraining rolls are inclined toward the restraining rolls from a horizontal plane in the jetting device.

8 Claims, 6 Drawing Sheets

(56) References Cited

FOREIGN PATENT DOCUMENTS

| | | | |
|---|---|---|---|
| EP | 1300478 | A1 | 4/2003 |
| EP | 3225705 | A1 | 10/2017 |
| JP | 46002733 | A | 1/1971 |
| JP | 5218124 | B1 | 5/1977 |
| JP | 59153843 | A | 9/1984 |
| JP | 62259610 | A | 11/1987 |
| JP | 0978143 | A | 3/1997 |
| JP | 11193418 | A | 7/1999 |
| JP | 2011184773 | A | 9/2011 |
| JP | 2014070272 | A | 4/2014 |

OTHER PUBLICATIONS

Extended European Search Report for European Application No. 16881717.9, dated Oct. 15, 2018, 6 pages.
Korean Office Action for Korean Application No. 10-2018-7018205, dated Dec. 2, 2019, with Concise Statement of Relevance of Office Action, 6 pages.
Chinese Office Action with Search Report for Chinese Application No. 201680076403.1, dated Mar. 6, 2019, 11 pages.
"Modern Steel Rolling," Tingpu Wang Metallurgy, Industry Press, Aug. 31, 2014, 5 pages.
Chinese Office Action with Search Report for Chinese Application No. 201680076403.1, dated Aug. 19, 2019, 14 pages.

* cited by examiner

RAPID-COOLING QUENCHING APPARATUS AND RAPID-COOLING QUENCHING METHOD

CROSS REFERENCE TO RELATED APPLICATIONS

This is the U.S. National Phase application of PCT/JP2016/088643, filed Dec. 26, 2016, which claims priority to Japanese Patent Application No. 2015-256541, filed Dec. 28, 2015 and Japanese Patent Application No. 2016-238977, filed Dec. 9, 2016, the disclosures of these applications being incorporated herein by reference in their entireties for all purposes.

TECHNICAL FIELD OF THE INVENTION

Aspects of the present invention relate to a rapid-cooling quenching apparatus and a rapid-cooling quenching method in which it is possible to suppress a decrease in the cooling rate of a metal sheet while reducing shape defects, which occurs in the metal sheet when rapid-cooling quenching is performed, in continuous annealing equipment in which annealing is performed while the metal sheet continuously passes through the equipment.

BACKGROUND OF THE INVENTION

When a metal sheet such as a steel sheet is manufactured, material properties are made up by, for example, allowing phase transformation to occur by cooling the metal sheet after having heated the metal sheet in continuous annealing equipment. Nowadays, there is an increasing demand in the automobile industry for a high-tensile strength steel sheets (high-tensile steel sheets) having a reduced thickness in order to simultaneously achieve the weight reduction and satisfactory collision safety in automobile bodies. When a high-tensile steel sheet is manufactured, a technique for rapidly cooling a steel sheet is important. Examples of a known method for cooling a steel sheet at a highest cooling rate include a water quenching method. In the water quenching method, rapid-cooling quenching is performed on a steel sheet by dipping a heated steel sheet in water and at the same time jetting cooling water onto the heated steel sheet through quenching nozzles placed in the water. When rapid-cooling quenching is performed on a steel sheet, there is a problem in that shape defects such as warpage and wave-like deformation occur in the steel sheet. To date, various methods have been proposed in order to prevent such shape defects from occurring when rapid-cooling quenching is performed on a steel sheet.

For example, Patent Literature 1 proposes, in order to reduce wave-like deformation occurring in a metal sheet when rapid-cooling quenching is performed in a continuous annealing furnace, a tension-changing technique in which bridle rolls are placed upstream and downstream of a rapid-cooling quenching zone in order to change the tension which is applied to a steel sheet to be subjected to a rapid-cooling quenching process. In addition, Patent Literature 2 proposes a technique in which the shape of a steel sheet is corrected so as to be flat by applying tension to at least the whole region in the width direction of the front and back surfaces of the steel sheet when quenching is performed.

However, in the case of the method according to Patent Literature 1, since a large tension is applied to a high-temperature steel sheet, there is a risk of rupture occurring in the steel sheet. In addition, since a large thermal crown is formed on the bridle rolls placed upstream of the rapid-cooling quenching zone which are in contact with a high-temperature steel sheet, the bridle rolls and the steel sheet are in contact with each other unevenly in the width direction. As a result, buckling and flaws occur in the steel sheet, which results in a problem in that it is not possible to improve the shape of the steel sheet. In addition, in the case of the method according to Patent Literature 2, although there is a decrease in warpage quantity to about several mm in response to application of a tension of 15 N/mm$^2$, there is a risk in that a contraction occurs in a steel strip due to such a high tension.

The present applicant has filed Japanese Patent Application No. 2014-240836 regarding a technique for solving such problems. FIG. 1 illustrates a rapid-cooling quenching apparatus used in Japanese Patent Application No. 2014-240836. In FIG. 1, a jetting device 4, through which cooling water is jetted onto a metal sheet 5 in order to cool the metal sheet to the water temperature, is provided in a water tank 1. In the jetting device 4, while the cooling water is jetted through nozzles 14 and 24 onto the metal sheet 5 in order to rapidly cool the metal sheet 5, the metal sheet 5 is restrained with restraining rolls 7 which are placed in the water and thus the deformation of the metal sheet is suppressed when rapid cooling is performed.

CITATION LIST

Patent Literature

PTL 1: Japanese Unexamined Patent Application Publication No. 2011-184773

PTL 2: Japanese Unexamined Patent Application Publication No. 11-193418

SUMMARY OF THE INVENTION

Although it is certainly possible to prevent deformation of a steel sheet when rapid-cooling quenching is performed by using the rapid-cooling quenching apparatus illustrated in FIG. 1, there is a problem of a deterioration in the properties of the metal sheet due to a temporary decrease in the cooling rate of the metal sheet when the metal sheet passes through the jetting device 4. Specifically, there may be a case in which it is not possible to obtain a metal sheet having a desired tensile strength due to a decrease in the cooling rate of the metal sheet.

Moreover, since there is only one pair of restraining rolls in the case of the rapid-cooling quenching apparatus illustrated in FIG. 1, the surface of the steel sheet does not become completely flat although the shape defects of the steel sheet are reduced to some extent, which results in a problem in that a warpage of 5 mm or more may remain in the steel sheet.

From the results of the investigations conducted by the present inventors, it was found that the cooling rate of a metal sheet tends to decrease particularly in the vicinity of the restraining rolls 7 which are in contact with a high-temperature metal sheet. This will be described more specifically by using FIG. 2. As illustrated by arrows in FIG. 2, water which is jetted through nozzles 14 and 24 hits the front and back surfaces of a metal sheet 5 inside a jetting device 4. At this time, water jetted through the nozzles 14 and 24 which are located above or below the restraining rolls 7 realizes sufficient cooling capability by hitting the metal sheet 5. On the other hand, water jetted through the nozzles 14 and 24 which are located at the level of the restraining rolls 7 is prevented by the restraining rolls 7 from reaching the front or back surface of the metal sheet 5. It was found that the cooling rate of the metal sheet tends to decrease in the vicinity of the restraining rolls 7 for such a reason. In addition, the temperature of the restraining rolls 7, which are always in contact with the high-temperature metal sheet 5, tends to increase. In addition, the cooling rate of the metal sheet 5 also tends to decrease in the vicinity of the restraining rolls 7 due to an increase in the temperature of the restraining rolls 7.

Aspects of the present invention have been completed in view of the problems described above. An object of aspects of the present invention is to provide a rapid-cooling quenching apparatus and a rapid-cooling quenching method with which it is possible to suppress a decrease in the cooling rate of a metal sheet in the vicinity of restraining rolls while shape defects occurring in the metal sheet are reduced to the maximum extent when rapid-cooling quenching is performed.

The solution to the problem described above according to various aspects of the present invention is as follows.

[1] A rapid-cooling quenching apparatus in which a high-temperature metal sheet is dipped and cooled in a liquid, the apparatus including a water tank containing the liquid in which the metal sheet is dipped, a jetting device having a plurality of nozzles through which the liquid is jetted onto front and back surfaces of the metal sheet and at least some of which are placed in the liquid in the water tank, and a pair of restraining rolls which are placed between an entrance-side end of the jetting device and an exit-side end of the jetting device and restrain the metal sheet, in which nozzles nearest to the restraining rolls are inclined toward the restraining rolls from a horizontal plane in the jetting device.

[2] A rapid-cooling quenching apparatus in which a high-temperature metal sheet is dipped and cooled in a liquid, the apparatus including a water tank containing the liquid in which the metal sheet is dipped, a jetting device having a plurality of nozzles through which the liquid is jetted onto front and back surfaces of the metal sheet and at least some of which are placed in the liquid in the water tank, and a plurality of pairs of restraining rolls which are placed between an entrance-side end of the jetting device and an exit-side end of the jetting device and restrain the metal sheet, in which nozzles nearest to the restraining rolls are inclined toward the restraining rolls from a horizontal plane in the jetting device.

[3] The rapid-cooling quenching apparatus according to item [1] or [2], in which the nozzles nearest to the restraining rolls form an angle of 20° or more and 60° or less with the metal sheet.

[4] A rapid-cooling quenching method by which a high-temperature metal sheet is dipped and cooled in a liquid contained in a water tank, the method including restraining the metal sheet by using a pair of restraining rolls placed between an entrance-side end of a jetting device and an exit-side end of the jetting device while the liquid is jetted through nozzles in the jetting device onto front and back surfaces of the metal sheet which is dipped in the liquid, in which the liquid is jetted obliquely toward the restraining rolls through nozzles nearest to the restraining rolls.

[5] A rapid-cooling quenching method by which a high-temperature metal sheet is dipped and cooled in a liquid contained in a water tank, the method including restraining the metal sheet by using a plurality of pairs of restraining rolls placed between an entrance-side end of a jetting device and an exit-side end of the jetting device while the liquid is jetted through nozzles in the jetting device onto front and back surfaces of the metal sheet which is dipped in the liquid, in which the liquid is jetted obliquely toward the restraining rolls through nozzles nearest to the restraining rolls.

[6] The rapid-cooling quenching method according to item [4] or [5], in which the liquid is jetted from the nozzles nearest to the restraining rolls in a direction at an angle of 20° or more and 60° or less to the metal sheet.

According to aspects of the present invention, it is possible to prevent a temporary decrease in the cooling rate of a metal sheet in the vicinity of restraining rolls when rapid-cooling quenching is performed.

DETAILED DESCRIPTION OF EMBODIMENTS OF THE INVENTION

Hereafter, the embodiments of the present invention will be specifically described with reference to the accompanying drawings.

Figure 3:
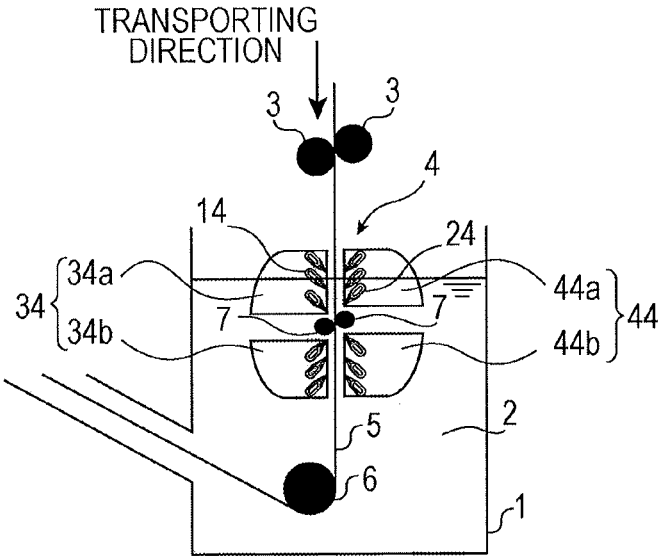
FIG. 3 is a diagram illustrating a rapid-cooling quenching apparatus according to an embodiment of the present invention.
Figure 4:
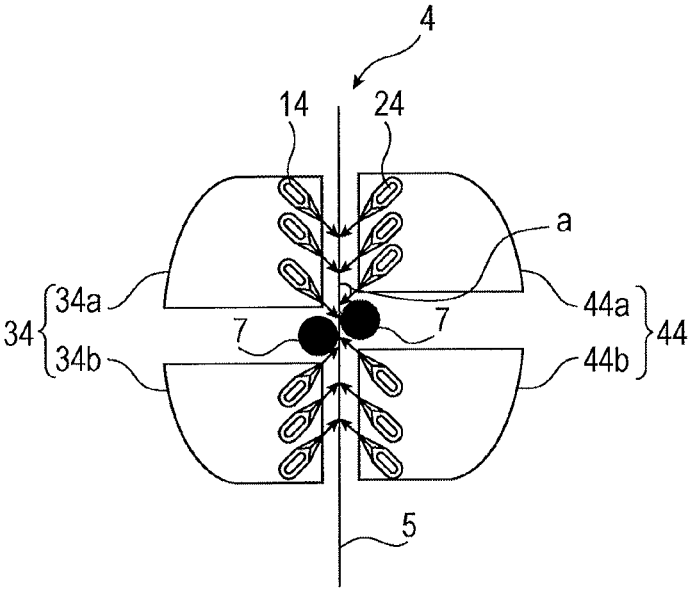
FIG. 4 is an enlarged diagram illustrating a part in the vicinity of a jetting device 4 in FIG. 3.

FIG. 3 is a diagram illustrating a rapid-cooling quenching apparatus according to an embodiment of the present invention, and FIG. 4 is an enlarged diagram illustrating a part in the vicinity of a jetting device 4 of the rapid-cooling quenching apparatus. The rapid-cooling quenching apparatus can be used for cooling equipment which is placed on the exit side of the soaking zone of a continuous annealing furnace. In FIG. 3, a pair of seal rolls 3, which are placed at the exit of the soaking zone of a continuous annealing furnace, are illustrated. The rapid-cooling quenching apparatus has a water tank 1 containing water 2, which is a coolant (liquid) for cooling a metal sheet 5, a jetting device 4 for cooling the metal sheet 5 by jetting the water 2 onto the metal sheet 5, and restraining rolls 7 for preventing deformation of the metal sheet 5 by restraining the metal sheet 5. In addition, a sink roll 6 for changing the conveying (threading) direction of the metal sheet 5 while dipping the metal sheet 5 in the water is placed on the exit side of the jetting device 4.

The jetting device 4 has a plurality of nozzles 14 and 24 for jetting water and nozzle units 34 and 44 for holding the nozzles 14 and 24 respectively. There is a gap between a pair of nozzle units 34 and 44. Water is jetted through the nozzles 14 and 24 toward the front and back surfaces of the metal sheet 5 when the metal sheet 5 passes through the gap described above. In the example in FIG. 3 (and FIG. 4), the left side of the metal sheet 5 is the front surface, and the right side thereof is the back surface. The nozzle unit 34 is arranged so that the nozzles 14 are oriented toward the front surface of the metal sheet 5 on the left side of the figure, and the nozzle unit 44 is arranged so that the nozzles 24 are oriented toward the back surface of the metal sheet 5 on the right side of the figure.

In the example in FIG. 3 and FIG. 4, each of the nozzle units 34 and 44 is divided into two parts in the conveying direction. An entrance-side nozzle unit 34*a* and an exit-side nozzle unit 34*b* are placed on the side of the front surface of the metal sheet 5, and an entrance-side nozzle unit 44*a* and an exit-side nozzle unit 44*b* are placed on the side of the back surface of the metal sheet 5. The restraining rolls 7 are placed between the entrance-side nozzle units 34*a* and 44*a* and the exit-side nozzle units 34*b* and 44*b*. As a result, the restraining rolls 7 are placed between the entrance-side end of the jetting device (the entrance-side end surfaces of the entrance-side nozzle units 34*a* and 44*a* in FIG. 3) and the exit-side end of the jetting device (the exit-side end surfaces of the exit-side nozzle units 34*b* and 44*b* in FIG. 3).

Figure 1:
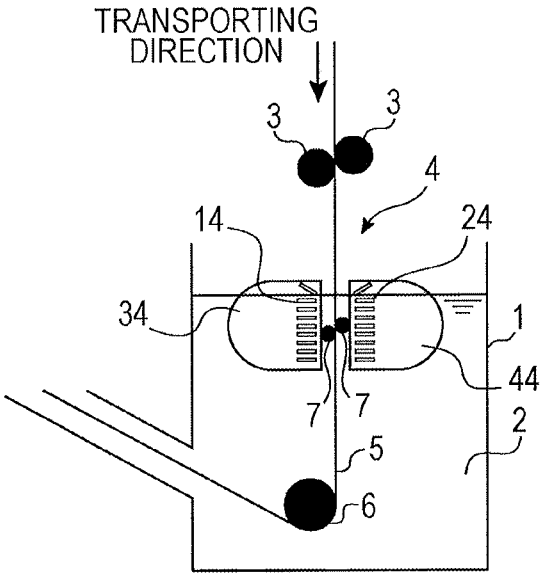
FIG. 1 is a diagram illustrating a conventional rapid-cooling quenching apparatus.

The entrance-side nozzle units 34*a* and 44*a* are arranged so that a portion of each unit is dipped in water and the rest is above the water. A threaded metal sheet 5 is fed through a gap between the entrance-side nozzle units 34*a* and 44*a*, which is exposed above the water, and subsequently dipped in the water, and water is jetted through the nozzles 14 and 24. A plurality of nozzles 14 and 24 are provided in the entrance-side nozzle units 34*a* and 44*a* respectively. Openings of some of the nozzles (for example, nozzles which are placed at the top of the entrance-side nozzle units 34*a* and 44*a* in FIG. 3) are located above the water, and at least some of the openings of the nozzles are not dipped in the water. Nozzles whose openings are located above the water are conventionally arranged to face obliquely downward (for example, as illustrated in FIG. 1) so that it is possible to jet water obliquely downward in order to suppress water spouting out which occurs when a high-temperature metal sheet 5 is fed into water.

The metal sheet 5 is restrained by the restraining rolls 7 after having passed through the entrance-side nozzle units 34*a* and 44*a*. The restraining rolls 7 press both front and back surfaces of the metal sheet 5 in the water in order to prevent deformation which may occur when the metal sheet 5 is rapidly cooled. It is preferable that a pair of restraining rolls 7 be arranged with some distance between the central axes thereof in the conveying direction of the metal sheet 5. By ensuring some distance between the central axes, the force to restrain the metal sheet 5 is increased and thus it is possible to enhance the shape correcting capability. For example, it is preferable that the restraining rolls 7 be arranged with a distance of 40 mm or more and 150 mm or less, or more preferably 80 mm or more and 100 mm or less, between the central axes thereof in the conveying direction.

In addition, it is preferable that the metal sheet 5 be pushed-in by the restraining rolls 7 and threaded such that the metal sheet 5 is wound around the restraining rolls 7. By pushing-in the metal sheet 5, it is possible to increase the capability for correcting the shape of a steel sheet, and it is possible to prevent the restraining rolls 7 from idly rotating. It is preferable that the pushing-in amount by one restraining roll 7 be 0 mm or more and 2.5 mm or less, or more preferably 0.5 mm or more and 1.0 mm or less, in the case where the pushing-in amount of the metal sheet 5 being threaded in a straight line, as illustrated in FIG. 3 and FIG. 4, corresponds to the reference value (0 mm).

The metal sheet 5 passes through the gap between the exit-side nozzle units 34*b* and 44*b* after having passed through the restraining rolls 7. Also, at this time, water is jetted through the nozzles 14 and 24, which are fitted in the exit-side nozzle units 34*b* and 44*b* respectively, onto the front and back surface of the metal sheet 5.

In the example in FIG. 3, the nozzle units are arranged so that the restraining rolls 7 are interposed between the entrance-side nozzle units 34*a* and 44*a* and the exit-side nozzle units 34*b* and 44*b*, and a nozzle unit or a nozzle is not provided at the level of restraining rolls 7. In such example, nozzles which are located at the exit-side end of the entrance-side nozzle units 34*a* and 44*a* (the third nozzles from the top in the case of FIG. 3 and FIG. 4) and nozzles which are located at the entrance-side end of the exit-side nozzle units 34*b* and 44*b* (the third nozzles from the bottom in the case of FIG. 3 and FIG. 4) are nozzles nearest to the restraining rolls 7 (hereinafter, also referred to as "nearest nozzles").

In conventional examples, the nearest nozzles are arranged horizontally, but the nearest nozzles mentioned above are not arranged horizontally and are inclined so that the openings of the nozzles are oriented toward the restraining rolls 7 from a horizontal plane. More specifically, the nearest nozzles which are located at the exit-side end of the entrance-side nozzle units 34*a* and 44*a* in FIG. 4 are fitted so as to be inclined downward, and the nearest nozzles which are located at the entrance-side end of the exit-side nozzle units 34*b* and 44*b* are fitted so as to be inclined upward. In the case where the nearest nozzles are inclined as described above, it is possible to allow water which is jetted through the nearest nozzles to reach up to a position closer to the contact point between the restraining rolls 7 and the metal sheet 5 than in the case of conventional examples where the nearest nozzles are fitted so as to be horizontal. Accordingly, it is possible to prevent a decrease in the capability for cooling the metal sheet 5 in the vicinity of the restraining rolls 7 which occurs because water jetted through nozzles in the vicinity of the restraining rolls 7 is less likely to come into contact with the front and back surfaces of the metal sheet 5.

Although nozzles other than the nearest nozzles are all fitted so as to be inclined in the same direction as the nearest nozzles in the example in FIG. 3 and FIG. 4, the nozzles other than the nearest nozzles may be fitted so as to be horizontal as in the conventional examples. However, it is preferable that all the nozzles in each nozzle unit be inclined at the same angle in the same direction from the viewpoint of decreasing a variation in the cooling effect in the longitudinal direction by causing water to be in contact with the metal sheet 5 uniformly as much as possible.

As illustrated in FIG. 4, the inclination angle of the nearest nozzles may be defined as an angle a which is an acute angle among the angles formed between the axis direction (water-jetting direction) of the nearest nozzles and the metal sheet. Here, although water jetted through a nozzle spreads to some extent, the water-jetting direction mentioned above may be defined as the central axis direction of water jetted through a nozzle. The angle a may be set in accordance with, for example, the flow rate of water jetted through the nearest nozzles, the distance between the openings of the nearest nozzles and the restraining rolls 7, and the distance between the openings of the nearest nozzles and the front and back surface of the metal sheet 5. A preferable example of the angle a is 20° or more and 60° or less. In the case where the angle a is less than 20°, since the flow of water jetted through the nearest nozzle is disturbed by the nearest restraining roll 7, it is not possible to allow water to reach up to a position near the contact position between the restraining roll 7 and the metal sheet 5, which results in an insufficient effect of suppressing a decrease in the cooling rate of the metal sheet 5 in the vicinity of the restraining roll 7. In addition, in the case where the angle a is more than 60°, since water is jetted in a direction almost at a right angle to the front and back surfaces of the metal sheet 5, it is not possible to allow the jetted water to come into sufficient contact with the front and back surfaces of the metal sheet 5 in the vicinity of the restraining roll 7, which results in a decrease in the capability for cooling the metal sheet 5. It is more preferable that the angle a be 30° or more and 45° or less. Here, when a nozzle is inclined, at least the front end of the nozzle may be inclined so that it is possible to jet water obliquely through the nozzle.

The rapid-cooling quenching apparatus according to aspects of the present invention may have an inseparable nozzle unit which is formed in a single-piece structure in the conveying direction of the metal sheet 5. By using FIG. 5, an example in which an inseparable nozzle unit is used will be described.

Figure 5:
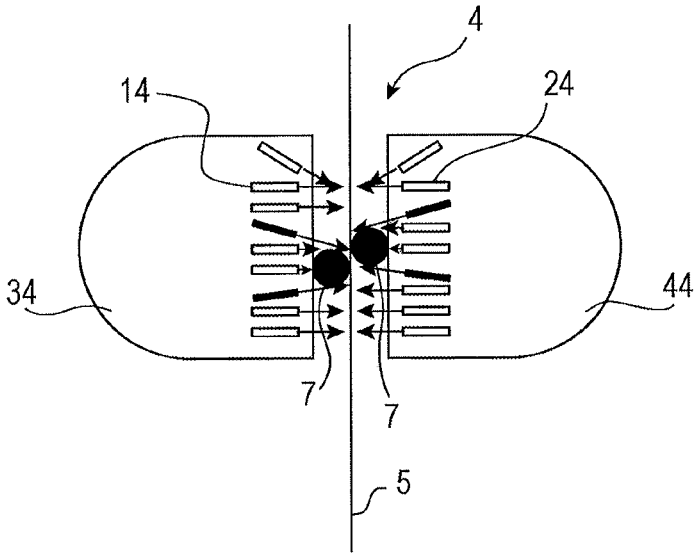
FIG. 5 is a diagram illustrating another example of a rapid-cooling quenching apparatus according to an embodiment of the present invention.

In the example in FIG. 5, the nozzle units 34 and 44 on the left and right side are not divided in the conveying direction and each of the nozzle units 34 and 44 is formed in a single-piece structure. The restraining rolls 7 are placed in the gap between the nozzle units 34 and 44. In the case of such example in which inseparable nozzle units are used, there may be nozzles whose openings are located at the level of the restraining rolls 7 (in the example in FIG. 5, which correspond to the 5th and the 6th nozzles from the top of the nozzle unit 34, and the 4th and the 5th nozzles from the top of the nozzle unit 44) among the plurality of nozzles 14 and 24 fitted in the nozzle units 34 and 44. In such a case, among the nozzles other than those whose openings are located at the level of the restraining rolls 7, nozzles nearest to the restraining rolls 7 are defined as the nearest nozzles. In addition, nozzles whose openings are located at the level of the restraining rolls 7 might not be provided in the nozzle units 34 and 44 from the beginning. In FIG. 5, the nearest nozzles are indicated by being blackened.

Also in the case where inseparable nozzle units are used, it is possible to prevent a decrease in the cooling rate of the metal sheet 5 in the vicinity of the restraining rolls 7 by inclining the nearest nozzles toward the restraining rolls 7.

Here, it is more preferable to use divided nozzle units (FIG. 3 and FIG. 4) than inseparable nozzle units (FIG. 5), because using divided nozzle units facilitates, for example, the attachment, removal, and maintenance of the restraining rolls 7 and increases the cooling capability by decreasing the distance between the openings of the nozzles 14 and 24 and the metal sheet 5.

Nozzles in the jetting device 4 are connected to piping in which a pump is fitted, although this is not illustrated. The water 2 in the water tank 1 is pumped up through the piping, pressurized and fed to nozzles 14 and 24 by using the pump in order to jet high-pressure water through the openings of the nozzles 14 and 24. In addition, the water 2 in the water tank 1 is kept at a temperature appropriate for quenching. An increase in water temperature in the water tank 1 is prevented by transferring a part of the water 2 in the water tank 1 to a cooling apparatus such as an external cooling tower in order to cool the water and by returning the cooled water 2 to the water tank 1. For example, it is preferable that the water temperature in the water tank 1 be higher than 0° C. and 50° C. or lower, or particularly preferably 10° C. or higher and 40° C. or lower.

It is preferable that the restraining rolls 7 be rotated in the circumferential direction by electricity in order to prevent a roll mark occurring in a metal sheet. Moreover, it is preferable that the restraining rolls 7 be openable and closable (capable of controlling the pushing-in amount of the metal sheet 5) as needed in order to control capability for correcting the shape of the metal sheet 5.

The restraining rolls 7 may be composed of a material having good thermal conductivity and sufficient strength to resist a load applied when the metal sheet 5 is pushed-in. Examples of a material for the restraining rolls 7 include SUS304, SUS310, and ceramic. Here, a material prescribed in JIS (Japanese Industrial Standards) corresponding to SUS304 or SUS310 may be used.

Hereafter, examples in which a plurality of pairs of restraining rolls 7 are used will be described by using FIG. 6 through FIG. 9. Hereinafter, description similar to that in the case where a pair of restraining rolls 7 are used will be omitted.

Figure 6:
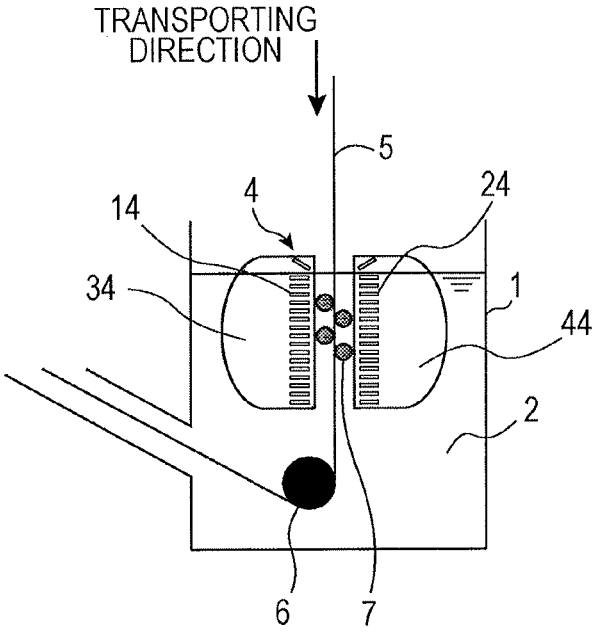
FIG. 6 is a diagram illustrating a rapid-cooling quenching apparatus according to an embodiment of the present invention.
Figure 7:
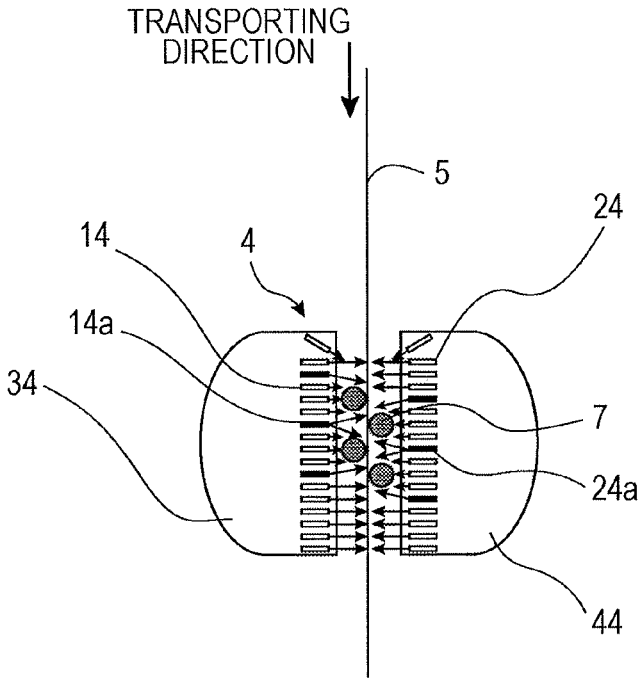
FIG. 7 is an enlarged diagram illustrating a part in the vicinity of a jetting device 4 in FIG. 6.

In the example in FIG. 6 and FIG. 7, the front and back surfaces of a metal sheet 5 are restrained by two pairs of restraining rolls 7. Also in this case, among the nozzles other than those whose openings are located at the level of the restraining rolls 7, nozzles nearest to the restraining rolls 7 may be defined as the nearest nozzles as in the case described above.

The nearest nozzles are indicated by being blackened in FIG. 7. Also in this example, it is possible to prevent a decrease in the cooling rate of the metal sheet 5 in the vicinity of the restraining rolls 7 by inclining the nearest nozzles toward the restraining rolls 7. Here, a nearest nozzle which is located between the restraining rolls 7 may be inclined toward any one of the restraining rolls 7 which are adjacent to the nearest nozzle. Moreover, the tip of such a nozzle may be branched so that each branch is inclined toward a corresponding one of the adjacent restraining rolls 7. Specifically, in FIG. 7, a nearest nozzle 14*a*, which is the 7th nozzle from the top on the front-surface side, and a nearest nozzle 24*a*, which is the 9th nozzle from the top on the back-surface side, are configured to be capable of jetting water upward and downward.

Figure 8:
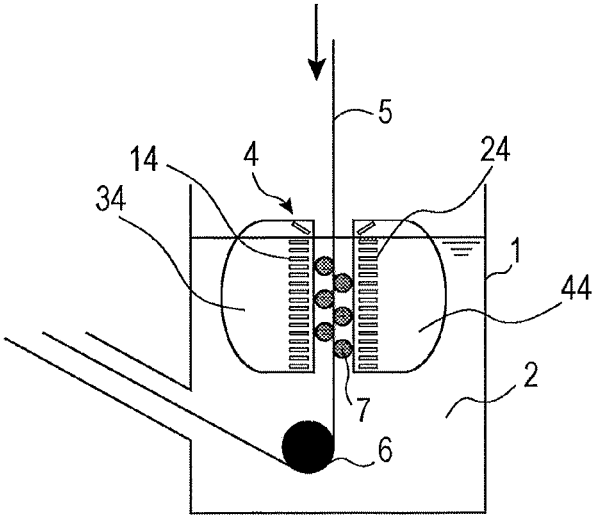
FIG. 8 is a diagram illustrating a rapid-cooling quenching apparatus according to an embodiment of the present invention.
Figure 9:
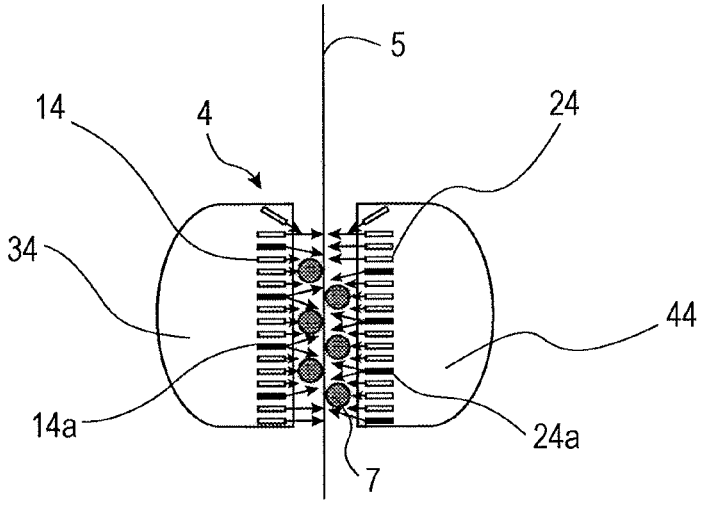
FIG. 9 is an enlarged diagram illustrating a part in the vicinity of a jetting device 4 in FIG. 8.

FIG. 8 and FIG. 9 illustrate an example in which the front and back surfaces of a metal sheet 5 are restrained by three pairs of restraining rolls 7. Also in this example, nearest nozzles are inclined toward the restraining rolls 7 as in the case described above.

Also in the examples in which a plurality of pairs of restraining rolls are used, a preferable example of the angle a, at which the nearest nozzles are inclined, is 20° or more and 60° or less, or more preferably 30° or more and 45° or less for the same reasons as in the example in which only one pair of restraining rolls are used.

Also in the examples in which a plurality of pairs of restraining rolls are used, it is preferable that the metal sheet be pushed-in by the restraining rolls for the same reasons as in the example in which only one pair of restraining rolls are used. It is preferable that the push-in amount by each restraining roll be 0 mm or more and 2.5 mm or less. It is particularly preferable that the push-in amount be 0.5 mm or more and 1.0 mm or less.

In the examples in which a plurality of pairs of restraining rolls are used, it is preferable that the restraining rolls be arranged in a zigzag manner with some distance in the conveying direction between the restraining rolls placed on the front and back surfaces of the steel sheet. With this, it is possible to increase the shape correcting capability by increasing the force to restrain the metal sheet 5. Here, it is preferable that the distance in the conveying direction between the central axes of the nearest two restraining rolls arranged to face each other among the restraining rolls 7 be 40 mm or more and 150 mm or less, or more preferably 80 mm or more and 100 mm or less, for the same reasons as described above.

In the examples in which a plurality of pairs of restraining rolls are used, it is possible to achieve a higher capability for correcting the shape of a steel sheet when cooling is performed than in the example in which only one pair of restraining rolls is used. In particular, even in the case where a high-strength steel sheet is cooled, in which deformation tends to occur, it is possible to further reduce deformation such as warpage occurring in a steel sheet, when the steel sheet is cooled, by using a plurality of pairs of restraining rolls. On the other hand, since there is a problem regarding facility condition and there is a problem of a decrease in the cooling capability of a jetting device in the case where the number of restraining rolls is excessively large, the number of restraining rolls may be appropriately determined in consideration of such problems.

It is particularly preferable that the rapid-cooling quenching apparatus and the rapid-cooling quenching method according to aspects of the present invention be used for manufacturing a high-strength cold-rolled steel sheet (high-tensile steel sheet), or, more specifically, a steel sheet having a tensile strength of 580 MPa or more. Although there is no particular limitation on the upper limit of tensile strength, for example, the upper limit may be 1600 MPa or less. When a high-tensile steel sheet is manufactured, it is important to perform accurate microstructure control by rapidly cooling a steel sheet. In the case of conventional rapid-cooling quenching apparatuses and rapid-cooling quenching methods, since there is a decrease in the cooling rate in the vicinity of restraining rolls 7, it is not possible to make up a desired metallographic structure, which results in a problem in that the strength of a high-tensile steel sheet becomes lower than the strength desired. By manufacturing a high-tensile steel sheet by using the rapid-cooling quenching apparatus and the rapid-cooling quenching method according to aspects of the present invention, it is possible to manufacture a high-tensile steel sheet having the desired strength with more certainty by preventing a decrease in the cooling rate in the vicinity of the restraining rolls 7.

Examples of a chemical composition of a high-strength cold-rolled steel sheet include one containing, by mass %, C: 0.04% or more and 0.25% or less, Si: 0.01% or more and 2.50% or less, Mn: 0.80% or more and 3.70% or less, P: 0.001% or more and 0.090% or less, S: 0.0001% or more and 0.0050% or less, sol. Al: 0.005% or more and 0.065% or less, optionally one or more of Cr, Mo, Nb, V, Ni, Cu, and Ti: 0.5% or less each, further optionally B and Sb: 0.01% or less each, and the balance being Fe and inevitable impurities.

Here, the embodiments of the present invention may be used not only for cooling a steel sheet with water but also for cooling any kind of metal sheet other than a steel sheet, and the embodiments may also be used for rapid-cooling quenching with a coolant other than water.

EXAMPLES

Hereafter, aspects of the present invention will be described more specifically by using examples.

Example 1 of the Present Invention

High-strength cold-rolled steel sheets having a thickness of 1.0 mm, a width of 1000 mm, and a tensile strength of 580 MPa grade to 1470 MPa grade were manufactured by using a rapid-cooling quenching apparatus illustrated in FIG. 3 and FIG. 4 with a passing speed of 1.0 m/s. The angle a, at which the nozzles 14 and 24 in the jetting device 4 were inclined, was 30° in all the cases. Here, the distance between the central axes of the restraining rolls was 80 mm in the passing direction, and the push-in amount, by the restraining rolls 7, of the metal sheet 5 was 0.5 mm in all the cases.

Figure 10:
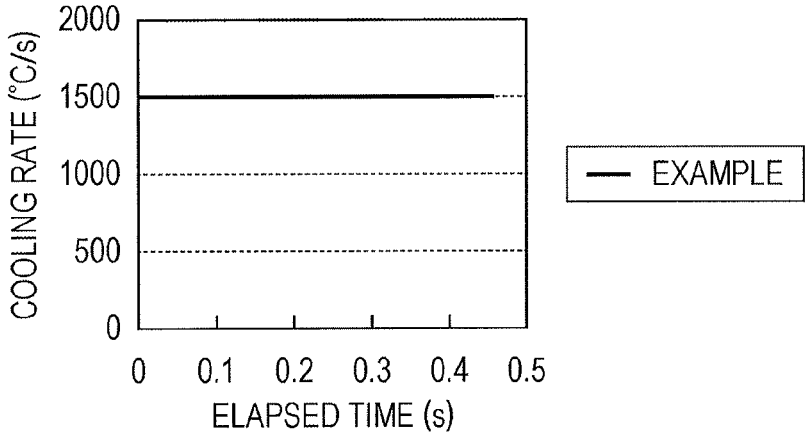
FIG. 10 is a graph showing the results of an example of an embodiment of the present invention.

In addition, the temperature of the steel sheet was measured while the steel sheet was threaded through the rapid-cooling quenching apparatus. Specifically, the temperature of the steel sheet was measured over time in the temperature-measurement region of the steel sheet by using a thermocouple-type thermometer. Here, the cooling start temperature (temperature immediately before the steel sheet entered the jetting device 4) of the steel sheet was 740° C., and the cooling stop temperature (temperature immediately after the steel sheet had come out of the water tank 1) was 50° C. The cooling rate of the steel sheet was calculated from the relationship between the elapsed time after cooling had been started and the temperature of the steel sheet. The results are shown in FIG. 10.

Figure 14:
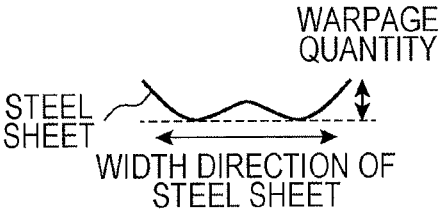
FIG. 14 is a schematic diagram illustrating a steel sheet viewed in the conveying direction.

In addition, the warpage quantity of the steel sheet was determined after the steel sheet had been threaded through the quenching apparatus. Description will be given specifically by using FIG. 14, which is a diagram illustrating a steel sheet viewed in the conveying direction. In the case where warpage occurred in a steel sheet, higher portions and lower portions are formed in the width direction of the steel sheet. The difference in height between the highest portion and the lowest portion of the steel sheet after the steel sheet had been threaded through the quenching apparatus was defined as warpage quantity.

Comparative Example 1

Figure 2:
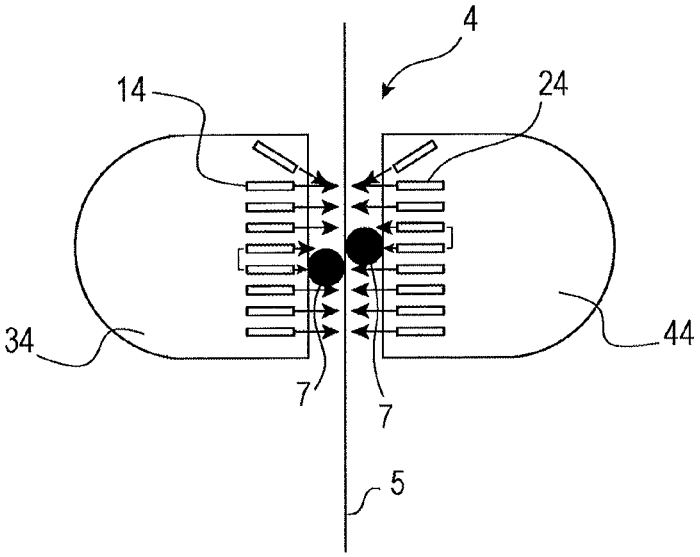
FIG. 2 is an enlarged diagram illustrating a part in the vicinity of a jetting device 4 in FIG. 1.
Figure 11:
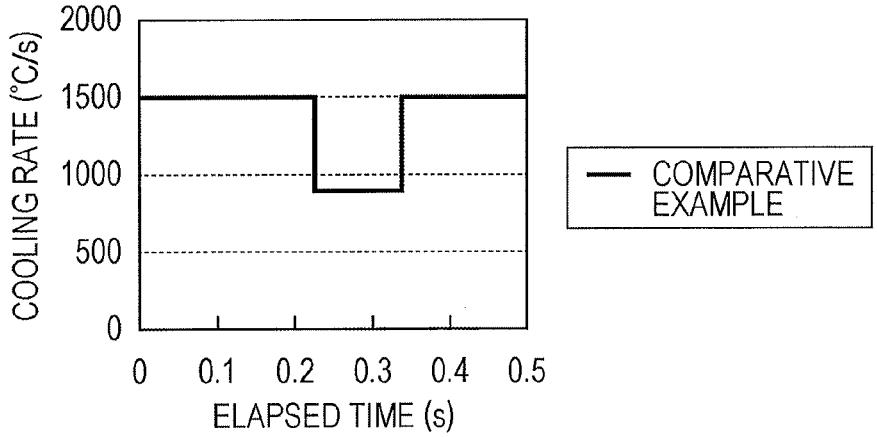
FIG. 11 is a graph showing the results of a comparative example.

The experiment was performed under the same conditions as Example 1 of the present invention with the exception that a rapid-cooling quenching apparatus illustrated in FIG. 1 and FIG. 2 was used. Here, the inclination angle of the nearest nozzles was 90°. The results are given in FIG. 11.

In FIG. 10 (Example of the present invention), the cooling rate of the steel sheet was almost constant without decreasing over time. On the other hand, in FIG. 11 (Comparative example), there was a decrease in the cooling rate by about 40% (1500° C./s to 900° C./s) between 0.2 (s) and 0.4 (s) in terms of elapsed time. During the time of such decrease in the cooling rate, the steel sheet was traveling in the vicinity of the restraining rolls 7. As described above, it is clarified that it is possible to suppress a decrease in the cooling rate of a metal sheet in the vicinity of restraining rolls by using the rapid-cooling quenching apparatus according to aspects of the present invention.

In addition, while the tensile strength of the steel sheet which was manufactured in Example 1 of the present invention was almost 1470 MPa, the tensile strength of the steel sheet which was manufactured in Comparative example 1 was about 1400 MPa, which means there was a decrease in tensile strength. It was possible to prevent a deterioration in the property of a steel sheet due to a decrease in the cooling rate in the vicinity of the restraining rolls by applying aspects of the present invention. Here, the results regarding the warpage quantity of the steel sheet will be described below.

Example 2 of the Present Invention

The same experiment as in Example 1 of the present invention was performed with the angle a being varied from 10° to 90° at intervals of 10°. Here, an example of the angle a of 90° was not included in the present invention but classified as a comparative example. The ratio of decrease in the cooling rate when the steel sheet passed in the vicinity of the restraining rolls was calculated and plotted in FIG. 12 for each value of the angles a with which the experiment was performed.

Figure 12:
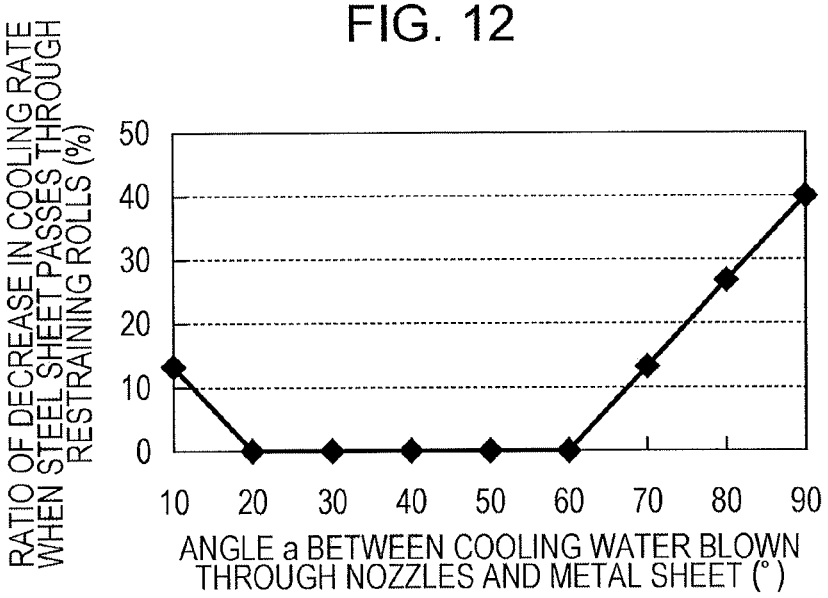
FIG. 12 is a graph showing the results of examples of an embodiment of the present invention and comparative examples.

As indicated in FIG. 12, in the case of the example in which the angle a was 90° (Comparative example), there was a decrease in the cooling rate by 40%. On the other hand, in the cases of all the examples in which the angle a was 10° to 80° (Examples of the present invention), it was possible to control the ratio of decrease in the cooling rate to be less than 30%. In particular, in the case of Examples in which the angle a was 20° or more and 60° or less, it was possible to prevent a decrease in the cooling rate of a steel sheet (the ratio of decrease in the cooling rate was 0%), which indicates that such a range is particularly preferable.

Example 3 of the Present Invention

Operation was performed under the same condition as in Example 1 of the present invention by using a rapid-cooling quenching apparatus illustrated in FIG. 6 and FIG. 7. Here, the restraining rolls facing each other were arranged with a distance of 80 mm between the central axes thereof in the conveying direction in all the cases, and the pushing-in amount, by the restraining rolls 7, of the metal sheet 5 was 0.5 mm in all the cases.

Example 4 of the Present Invention

Operation was performed under the same condition as in Example 1 of the present invention by using a rapid-cooling quenching apparatus illustrated in FIG. 8 and FIG. 9. Here, the restraining rolls facing each other were arranged with a distance of 80 mm between the central axes thereof in the conveying direction in all the cases, and the pushing-in amount, by the restraining rolls 7, of the metal sheet 5 was 0.5 mm in all the cases.

<Evaluation of Cooling Rate>

The determination results of the cooling rate of the steel sheets in Example 3 of the present invention and Example 4 of the present invention were the same as those in Example 1 of the present invention and shown in FIG. 10. From these results, it is also clarified that it is possible to suppress a decrease in the cooling rate of a metal sheet in the vicinity of restraining rolls in the case where a plurality of pairs of restraining rolls are used.

<Evaluation of Warpage Quantity>

Figure 13:
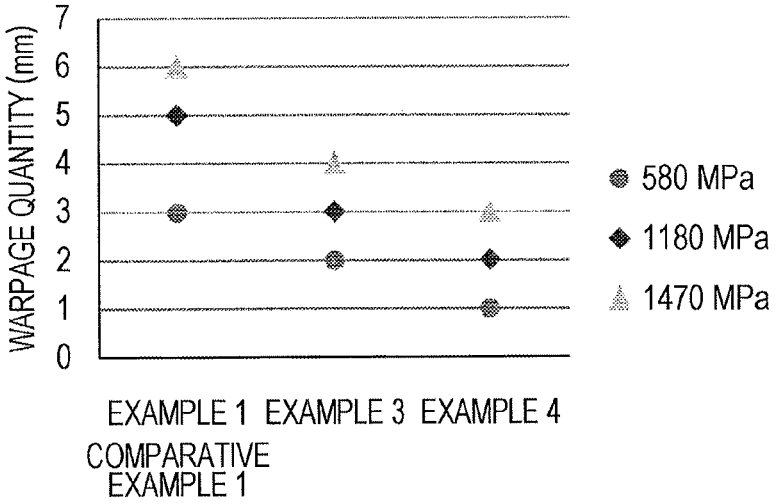
FIG. 13 is a graph showing the results of examples of an embodiment of the present invention and a comparative example.

The measurement results of the warpage quantity of the three kinds of steel sheets in Example 1 of the present invention, Examples 3 and 4 of the present invention, and Comparative example 1 are given in FIG. 13. The three kinds of steel sheets are classified in accordance with tensile strength into a steel sheet of 580 MPa grade, a steel sheet of 1180 MPa grade, and a steel sheet of 1470 MPa grade. Here, Example 1 of the present invention and Comparative example 1 were equivalent with each other in terms of the warpage quantity of a steel sheet. As indicated in FIG. 13, even in the case of a high-strength steel sheet, it was possible to decrease the warpage quantity of the steel sheet by increasing the number of restraining rolls. Therefore, it was clarified that it is possible to further prevent deformation occurring in a steel sheet when rapid-cooling quenching is performed by increasing the number of restraining rolls.

REFERENCE SIGNS LIST

1 water tank
2 water
3 seal roll
4 jetting device
5 metal sheet
6 sink roll
7, 17 restraining roll
11 rapid-cooling quenching apparatus
14, 24 nozzle
14*a*, 24*a* nearest nozzle
34, 44 nozzle unit
34*a*, 44*b* entrance-side nozzle unit
34*b*, 44*b* exit-side nozzle unit

The invention claimed is:

1. A rapid-cooling quenching apparatus in which a high-temperature metal sheet is dipped and cooled in a liquid, the apparatus comprising:

a water tank containing the liquid in which the metal sheet is dipped, a jetting device having a plurality of nozzles through which the liquid is jetted onto front and back surfaces of the metal sheet and at least some of which are placed in the liquid in the water tank, and a pair of restraining rolls which are placed between an entrance-side end of the jetting device and an exit-side end of the jetting device and restrain the metal sheet, wherein nozzles nearest to the restraining rolls are inclined toward the restraining rolls from a horizontal plane in the jetting device.

2. A rapid-cooling quenching apparatus in which a high-temperature metal sheet is dipped and cooled in a liquid, the apparatus comprising:

a water tank containing the liquid in which the metal sheet is dipped, a jetting device having a plurality of nozzles through which the liquid is jetted onto front and back surfaces of the metal sheet and at least some of which are placed in the liquid in the water tank, and a plurality of pairs of restraining rolls which are placed between an entrance-side end of the jetting device and an exit-side end of the jetting device and restrain the metal sheet, wherein nozzles nearest to the restraining rolls are inclined toward the restraining rolls from a horizontal plane in the jetting device.

3. The rapid-cooling quenching apparatus according to claim 1, wherein the nozzles nearest to the restraining rolls form an angle of 20° or more and 60° or less with the metal sheet.

4. A rapid-cooling quenching method by which a high-temperature metal sheet is dipped and cooled in a liquid contained in a water tank of a rapid-cooling quenching apparatus, the method comprising restraining the metal sheet by using a pair of restraining rolls of the rapid-cooling quenching apparatus placed between an entrance-side end of a jetting device and an exit-side end of the jetting device of the rapid-cooling quenching apparatus while the liquid is jetted through nozzles in the jetting device onto front and back surfaces of the metal sheet which is dipped in the liquid, at least some of the nozzles being placed in the liquid contained in the water tank, wherein the liquid is jetted obliquely toward the restraining rolls through nozzles which are nearest to the restraining rolls and which are inclined towards the restraining rolls from a horizontal plane in the jetting device.

5. A rapid-cooling quenching method by which a high-temperature metal sheet is dipped and cooled in a liquid contained in a water tank of a rapid-cooling quenching apparatus, the method comprising restraining the metal sheet by using a plurality of pairs of restraining rolls of the rapid-cooling quenching apparatus placed between an entrance-side end of a jetting device and an exit-side end of the jetting device of the rapid-cooling quenching apparatus while the liquid is jetted through nozzles in the jetting device onto front and back surfaces of the metal sheet which is dipped in the liquid, at least some of the nozzles being placed in the liquid contained in the water tank, wherein the liquid is jetted obliquely toward the restraining rolls through nozzles which are nearest to the restraining rolls and which are inclined towards the restraining rolls from a horizontal plane in the jetting device.

6. The rapid-cooling quenching method according to claim 4, wherein the liquid is jetted from the nozzles nearest to the restraining rolls in a direction at an angle of 20° or more and 60° or less to the metal sheet.

7. The rapid-cooling quenching apparatus according to claim 2, wherein the nozzles nearest to the restraining rolls form an angle of 20° or more and 60° or less with the metal sheet.

8. The rapid-cooling quenching method according to claim 5, wherein the liquid is jetted from the nozzles nearest to the restraining rolls in a direction at an angle of 20° or more and 60° or less to the metal sheet.

* * * * *